US008639128B2

(12) United States Patent
Kawamoto et al.

(10) Patent No.: US 8,639,128 B2
(45) Date of Patent: Jan. 28, 2014

(54) IMAGE OUTPUT APPARATUS, IMAGE TEST SYSTEM, AND DENSITY CORRECTION METHOD

(75) Inventors: Hiroyuki Kawamoto, Kanagawa (JP); Kazunari Tonami, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 217 days.

(21) Appl. No.: 13/067,748

(22) Filed: Jun. 23, 2011

(65) Prior Publication Data

US 2012/0002984 A1 Jan. 5, 2012

(30) Foreign Application Priority Data

Jul. 1, 2010 (JP) ..... 2010-151167
Apr. 5, 2011 (JP) ..... 2011-083950

(51) Int. Cl.
*G03G 15/00* (2006.01)

(52) U.S. Cl.
USPC ..... 399/15

(58) Field of Classification Search
USPC ..... 399/15, 49, 72
See application file for complete search history.

(56) References Cited

U.S. PATENT DOCUMENTS 6,243,542 B1 * 6/2001 Fujimoto et al. ..... 399/49
6,977,757 B1 12/2005 Takahashi et al.
7,106,476 B1 9/2006 Tonami et al.
7,142,330 B2 11/2006 Takahashi et al.
7,251,060 B2 7/2007 Tonami et al.
7,619,793 B2 11/2009 Tonami
7,636,179 B2 12/2009 Takahashi et al.
7,664,320 B2 2/2010 Yoshida et al.
7,673,165 B2 3/2010 Oteki et al.
7,692,816 B2 4/2010 Kawamoto et al.
7,710,599 B2 5/2010 Miyamoto et al.
2002/0063870 A1 * 5/2002 Narasimhan ..... 358/1.2
2004/0125411 A1 7/2004 Tonami et al.
2004/0257622 A1 12/2004 Shibaki et al.
2004/0257625 A1 12/2004 Tonami
2005/0089341 A1 * 4/2005 Choi ..... 399/50
2005/0260004 A1 * 11/2005 Maebashi et al. ..... 399/15
2006/0215205 A1 9/2006 Ohyama et al.

(Continued)

FOREIGN PATENT DOCUMENTS

JP 2007062207 A 3/2007
JP 2007310567 A 11/2007

(Continued)

OTHER PUBLICATIONS

Abstract of JP-2005028807, published Feb. 3, 2005.

*Primary Examiner* — David Gray
*Assistant Examiner* — Thomas Giampaolo, II
(74) *Attorney, Agent, or Firm* — Harness, Dickey & Pierce, P.L.C.

(57) ABSTRACT

An image output apparatus includes: an image forming unit that forms an image on a recording medium; a test-threshold acquiring unit that acquires a test threshold that is a pass-fail criterion for the image test for determining whether the test image data passes or fails the image test; a changing unit that changes a density detection mode of at least one of the image forming unit and the image reading apparatus on the basis of the test threshold; a density correcting unit that corrects density used in an image forming process performed by the image forming unit; and a reference-image-data acquiring unit that acquires the reference image data.

14 Claims, 7 Drawing Sheets

(56) References Cited

U.S. PATENT DOCUMENTS

| | | | | |
|---|---|---|---|---|
| 2007/0053009 | A1 | 3/2007 | Ito et al. | |
| 2007/0058224 | A1 | 3/2007 | Kawamoto et al. | |
| 2007/0064267 | A1 | 3/2007 | Murakata et al. | |
| 2007/0070405 | A1 | 3/2007 | Murakata et al. | |
| 2007/0086068 | A1 | 4/2007 | Ohkawa et al. | |
| 2007/0134012 | A1 * | 6/2007 | Suzuki et al. | 399/49 |
| 2007/0226692 | A1 | 9/2007 | Nozawa et al. | |
| 2008/0008388 | A1 | 1/2008 | Ohkawa et al. | |
| 2008/0037036 | A1 | 2/2008 | Togami et al. | |
| 2008/0043291 | A1 | 2/2008 | Togami et al. | |
| 2008/0068671 | A1 | 3/2008 | Yoshida et al. | |
| 2008/0094647 | A1 | 4/2008 | Takahashi et al. | |
| 2009/0231647 | A1 | 9/2009 | Tonami | |
| 2010/0165375 | A1 | 7/2010 | Miyamoto et al. | |

FOREIGN PATENT DOCUMENTS

| | | | |
|---|---|---|---|
| JP | 2008032926 | A | 2/2008 |
| JP | 2008102201 | A | 5/2008 |
| JP | 2008158504 | A | 7/2008 |
| JP | 2008160284 | A | 7/2008 |
| JP | 2008244644 | A | 10/2008 |
| JP | 4396165 | | 10/2009 |

* cited by examiner

IMAGE OUTPUT APPARATUS, IMAGE TEST SYSTEM, AND DENSITY CORRECTION METHOD

CROSS-REFERENCE TO RELATED APPLICATIONS

The present application claims priority to and incorporates by reference the entire contents of Japanese Patent Application No. 2010-151167 filed in Japan on Jul. 1, 2010 and Japanese Patent Application No. 2011-083950 filed in Japan on Apr. 5, 2011.

BACKGROUND OF THE INVENTION

1. Field of the Invention

The present invention relates to an image output apparatus, an image test system, and a density correction method.

2. Description of the Related Art

Conventionally, there is a known density correction technology for correcting the density of image data to be printed on a printed matter (see, for example, Japanese Patent Application Laid-open No. 2008-158504), and a known image testing technology for testing an image that has been printed on a printed matter (see, for example, Japanese Patent Application Laid-open No. 2007-310567). In recent years, print-on-demand printers increasingly have an image correcting technology as well as the image testing technology.

However, in a system having the image correcting technology and the image testing technology, if the accuracy of density correction is extremely low with respect to a pass-fail criterion for an image test, a large number of defective printed matters are generated. On the other hand, if the accuracy of density correction is extremely high with respect to the pass-fail criterion for the image test, processing time needed for the density correction increases. Therefore, in both cases, the productivity of printed matters decreases.

SUMMARY OF THE INVENTION

It is an object of the present invention to at least partially solve the problems in the conventional technology.

According to an aspect of the present invention, an image output apparatus includes: an image forming unit that forms an image on a recording medium; a test-threshold acquiring unit that compares test image data, the test image data being generated by an image reading apparatus by using the image formed on the recording medium and being used as a test object for an image test, with reference image data, the reference image data being used as a test reference for the image test, to thereby acquire a test threshold that is a pass-fail criterion for the image test for determining whether the test image data passes or fails the image test; a changing unit that changes a density detection mode of at least one of the image forming unit and the image reading apparatus on the basis of the test threshold; a density correcting unit that corrects density used in an image forming process performed by the image forming unit, on the basis of a result of density detection performed after the density detection mode is changed; and a reference-image-data acquiring unit that acquires the reference image data, and the image forming unit forms an image of the reference image data on a recording medium at the corrected density.

According to another aspect of the present invention, an image test system includes: an image reading apparatus that reads an image formed on a recording medium and generates test image data that is used as a test object for an image test; an image test apparatus that includes a test-threshold receiving unit that receives input of a test threshold that is a pass-fail criterion for the image test; and an image testing unit that acquires reference image data that is used as a test reference for the image test, acquires the test image data, compares the test image data with the reference image data, and determines whether a comparison result is in the range of the test threshold to thereby determine whether the test image data passes the image test; and an image output apparatus that includes an image forming unit that forms an image; a test-threshold acquiring unit that acquires, the test threshold; a changing unit that changes a density detection mode of at least one of the image forming unit and the image reading apparatus in accordance with the test threshold; a density correcting unit that corrects density used in an image forming process performed by the image forming unit, on the basis of a result of density detection performed after the density detection mode has been changed; and a reference-image-data acquiring unit that acquires the reference image data, and the image forming unit forms an image on a recording medium on the basis of the reference image data and at the corrected density.

According to still another aspect of the present invention, a density correction method to be performed by an image output apparatus that includes an image forming unit that forms an image on a recording medium, the density correction method includes: comparing, by a test-threshold acquiring unit, test image data, the test image data being generated by an image reading apparatus by using the image formed on the recording medium and being used as a test object for an image test, with reference image data, the reference image data being used as a test reference for the image test; acquiring, by the test-threshold acquiring unit, a test threshold that is a pass-fail criterion for the image test for determining whether the test image data passes or fails the image test, on the basis of a result obtained at the comparing; changing, by a changing unit, a density detection mode of at least one of the image forming unit and the image reading apparatus on the basis of the test threshold; correcting, by a density correcting unit, density used in an image forming process performed by the image forming unit, on the basis of a result of density detection performed after the density detection mode is changed; acquiring, by a reference-image-data acquiring unit, the reference image data; and forming, by the image forming unit, an image of the reference image data on a recording medium at the corrected density.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image output apparatus, an image test system, and a density correction method according to the present invention will be explained in detail below with reference to the accompanying drawings.

The configuration of an image test system according to a present embodiment will be described below.

Figure 1:
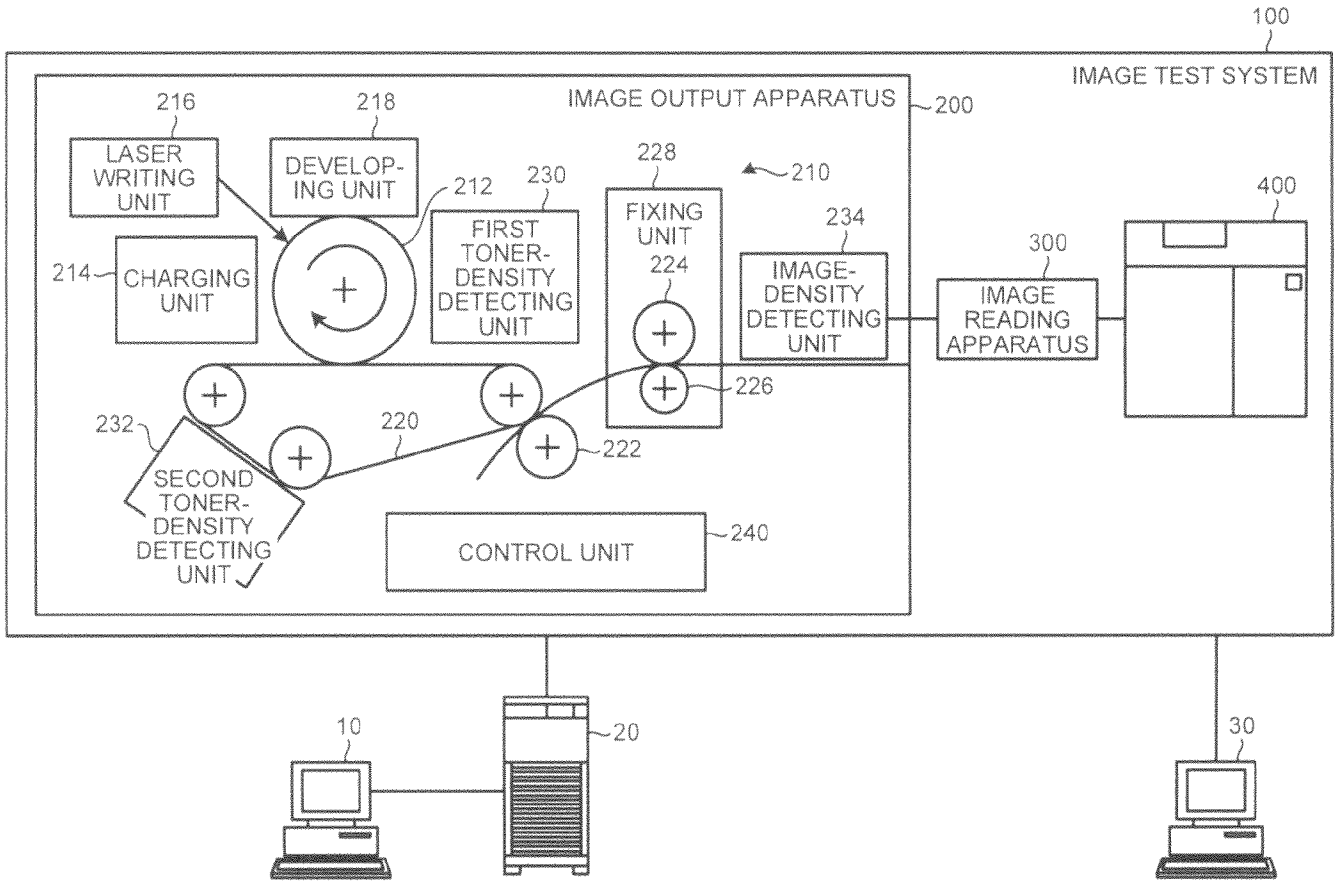
FIG. 1 is a schematic diagram of a configuration example of an image test system according to a present embodiment.

FIG. 1 is a schematic diagram of a configuration example of an image test system 100 according to the present embodiment. As illustrated in FIG. 1, the image test system 100 includes an image output apparatus 200, an image reading apparatus 300, and an image test apparatus 400. The apparatuses of the image test system 100 are connected to one another. The image test system 100 is connected to a DFE (Digital Front End) 20 and a control PC (Personal Computer) 30 via a network (not illustrated), such as LAN (Local Area Network). The image test system 100 and the DFE 20 may be directly connected to each other. The DFE 20 is connected to a user PC 10 via a network (not illustrated).

The user PC 10 is a computer terminal used by a user to give an instruction to perform printing, and the user PC 10 transmits print data, which contains print contents of an image to be printed, to the DFE 20 as a print instruction. The print data is data written in a PDL (Page Description Language), such as PostScript (registered trademark).

The DFE 20 is a print server and receives the print data from the user PC 10. The DFE 20 analyzes the received print data (the contents written in the PDL), performs the RIP (Raster Image Processor) process (rendering) on image data according to the analysis result, and generates bitmap (BMP) image data with any number of output bits that can be received by the image output apparatus 200. The bitmap image data generated by the DFE 20 is reference image data that is used as a test reference for an image test. According to the present embodiment, the DFE 20 generates CMYK image data (raster image) with 8 bits for each of CMYK at a resolution of 600 dpi, as the bitmap image data. The DFE 20 transmits the generated CMYK image data to the image output apparatus 200 and the image test apparatus 400.

The image output apparatus 200 is a general electrophotographic image forming apparatus. The image output apparatus 200 forms an image based on the CMYK image data transmitted from the DFE 20 on a recording sheet (which is an example of a recording medium) and outputs the recording sheet. Details of the image output apparatus 200 will be described later.

The image reading apparatus 300 reads the image that has been formed on the recording sheet by the image output apparatus 200 and generates RGB image data with 8 bits for each of RGB. The image reading apparatus 300 may be realized by, for example, a line sensor. The RGB image data generated by the image reading apparatus 300 is test image data that is used as a test object for the image test.

The control PC 30 is a computer terminal used by a user to control the image test system 100 and the control PC 30 transmits a test threshold, which is a pass-fail criterion for the image test, to the image test apparatus 400. The test threshold is set by a user through the control PC 30 in accordance with the required quality of a printed matter that is to be output by the image output apparatus 200 (a user image based on image data that is instructed to be printed by the user PC 10). Therefore, the control PC 30 transmits the test threshold set by the user to the image test apparatus 400. Examples of the test threshold include the upper limit of a color difference ΔE (e.g., ΔE=6) with which the test image data passes the image test. The control PC 30 receives a notice of the result of the image test from the image test apparatus 400. When the result of the image test indicates rejection, that is, when it is indicated that the test image data is defective, the control PC 30 notifies a user of the rejection by using a display (not illustrated) or the like.

Figure 2:
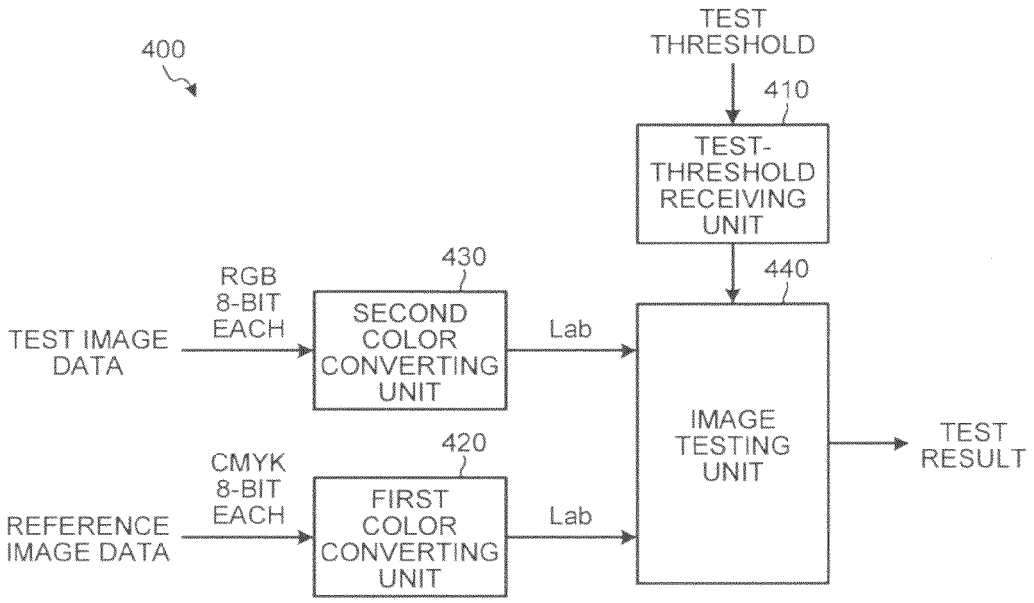
FIG. 2 is a block diagram of a configuration example of an image test apparatus according to the present embodiment.

The image test apparatus 400 performs the image test by using the CMYK image data generated by the DFE 20 and the RGB image data generated by the image reading apparatus 300. FIG. 2 is a block diagram of a configuration example of the image test apparatus 400 according to the present embodiment. As illustrated in FIG. 2, the image test apparatus 400 includes a test-threshold receiving unit 410, a first color converting unit 420, a second color converting unit 430, and an image testing unit 440.

The test-threshold receiving unit 410 receives input of the test threshold that is used as the pass-fail criterion for the image test. According to the present embodiment, the test-threshold receiving unit 410 receives, as the test threshold, input of the upper limit of the color difference ΔE (e.g., ΔE=6) from the control PC 30.

The first color converting unit 420 converts the 8-bit based CMYK image data that has been transmitted from the DFE 20 into reference image data in the Lab format that represents the Lab color space. The second color converting unit 430 converts the 8-bit-based RGB image data that has been transferred from the image reading apparatus 300 into test image data in the Lab format that represents the Lab color space.

The image testing unit 440 acquires the reference image data in the Lab format from the first color converting unit 420, acquires the test image data in the Lab format from the second color converting unit 430, and compares the acquired test image data and the acquired reference image data with each other. The image testing unit 440 determines whether the test image data passes or fails the image test depending on whether the comparison result is in the range of the test threshold received from the test-threshold receiving unit 410.

More specifically, the image testing unit 440 determines that the test image data passes the image test when the comparison result is in the range of the test threshold, and determines that the test image data does not pass (fails) the image test when the comparison result is not within the range of the test threshold. According to the present embodiment, the image testing unit 440 obtains the color difference ΔE between the test image data and the reference image data by the comparison. The image testing unit 440 determines that the test image data passes the image test when the comparison result is equal to or smaller than 6 that is the upper limit, and determines that the test image data fails the image test when the comparison result exceeds 6. The image testing unit 440 notifies the control PC 30 of the result of the image test.

Referring back to FIG. 1, the image output apparatus 200 will be described below. As illustrated in FIG. 1, the image output apparatus 200 includes an image forming unit 210 and a control unit 240.

The image forming unit 210 is a mechanism that forms an image based on the 8-bit-based CMYK image data that has been transmitted from the DFE 20 on a recording sheet. The image forming unit 210 includes a developing drum 212, a charging unit 214, a laser writing unit 216, a developing unit 218, an intermediate transfer belt 220, a transfer roller 222, a fixing unit 228 having a heating member 224 and a pressing member 226, a first toner-density detecting unit 230, a second toner-density detecting unit 232, and an image-density detecting unit 234.

The developing drum 212 is driven to rotate clockwise by a drive motor (not illustrated), and forms an image thereon through an image forming process performed by the charging unit 214, the laser writing unit 216, and the developing unit 218.

The charging unit 214 applies desired charges to the surface of the developing drum 212 to thereby uniformly charge the surface of the developing drum 212. More specifically, the charging unit 214 charges the surface of the developing drum 212 by the charging amount corresponding to a charge-potential control signal input from the control unit 240.

The laser writing unit 216 irradiates and exposes the surface of the developing drum 212 with laser light in accordance with an image signal of the CMYK image data input from the control unit 240, to thereby form an electrostatic latent image on the developing drum 212. More specifically, the laser writing unit 216 exposes the surface of the developing drum 212 by the exposing amount corresponding to an LD-power control signal input from the control unit 240.

The developing unit 218 develops the electrostatic latent image formed on the developing drum 212 to thereby form a toner image on the developing drum 212. More specifically, the developing unit 218 forms a toner image on the developing drum 212 at developing bias corresponding to a developing-bias control signal input from the control unit 240.

The toner image formed on the developing drum 212 is transferred on the intermediate transfer belt 220. The intermediate transfer belt 220 moves counterclockwise in FIG. 1 in an endless manner. When the transferred toner image reaches the position of the transfer roller 222, the toner image is transferred on a recording sheet (not illustrated) conveyed to the position of the transfer roller 222, so that the image is formed on the recording sheet.

When the recording sheet with the formed image is conveyed to the fixing unit 228, the heating member 224 heats the surface carrying the formed image while the pressing member 226 applies pressure to the opposite surface of the recording sheet, so that the image is fixed on the recording sheet.

Thereafter, the recording sheet with the fixed image is discharged to the outside of the image output apparatus 200 (to the image reading apparatus 300).

The first toner-density detecting unit 230 is a sensor that detects density of toner attached to the developing drum 212 and outputs a detection result to the control unit 240. The second toner-density detecting unit 232 is a sensor that detects density of toner attached to the intermediate transfer belt 220 and outputs a detection result to the control unit 240.

When the toner density is to be detected by the first toner-density detecting unit 230 and the second toner-density detecting unit 232, the control unit 240 instructs the image forming unit 210 to form a toner image as a density detection object, before a user image is formed on and output with a recording sheet or in the interval between outputs of recording sheets with user images. Therefore, the first toner-density detecting unit 230 and the second toner-density detecting unit 232 detect the toner density at a timing at which the toner image used for the density detection is formed. In the present embodiment, the control unit 240 counts the number of output recording sheets on which user images are formed, and the toner image for the density detection is formed in response to an instruction issued from the control unit 240 every ten recording sheets with formed user images are output. Therefore, the first toner-density detecting unit 230 and the second toner-density detecting unit 232 detect the toner density at this timing.

The image-density detecting unit 234 is a sensor that detects density of a density detection image (an output tone pattern) formed on a recording sheet.

When the image density is to be detected by the image-density detecting unit 234, the control unit 240 instructs the image forming unit 210 to generate the density detection image on a recording sheet in the interval between outputs of recording sheets with formed user images (printed matters), and output the recording sheet with the density detection image. Therefore, the image-density detecting unit 234 detects the image density at a timing at which the density detection image is formed and output. In the present embodiment, the control unit 240 counts the number of output recording sheets on which user images are formed, and the density detection image is formed on and output with the recording sheet in response to an instruction from the control unit 240 every ten recording sheets with formed user images are output. Therefore, the image-density detecting unit 234 detects the image density at this timing.

Figure 3:
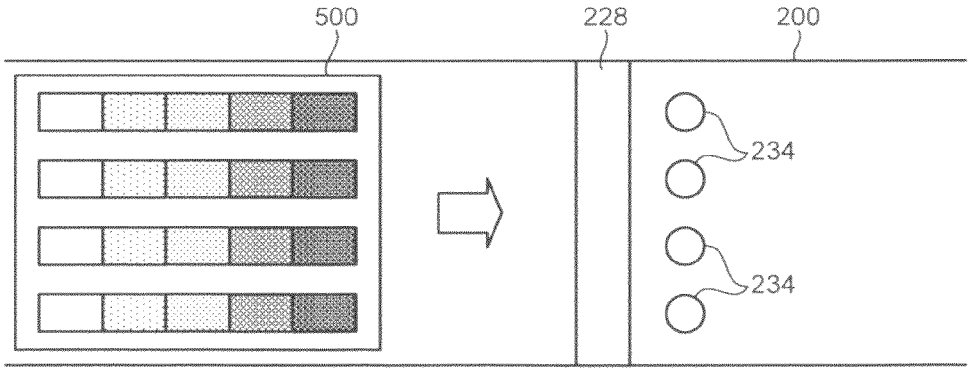
FIG. 3 is a diagram illustrating an exemplary arrangement of density detecting units according to the present embodiment.

According to the present embodiment, as illustrated in FIG. 3, a plurality of the image-density detecting units 234 (four in the example illustrated in FIG. 3) is arranged in the image output apparatus 200 in accordance with density detection positions of the density detection images (output tone patterns) formed on a recording sheet 500. Consequently, it is possible to detect the image density at a plurality of positions by performing the image density detection only once, so that it is possible to reduce the number of recording sheets to be output. However, it is possible to arrange a single image-density detecting unit 234 in the image output apparatus 200

Figure 4:
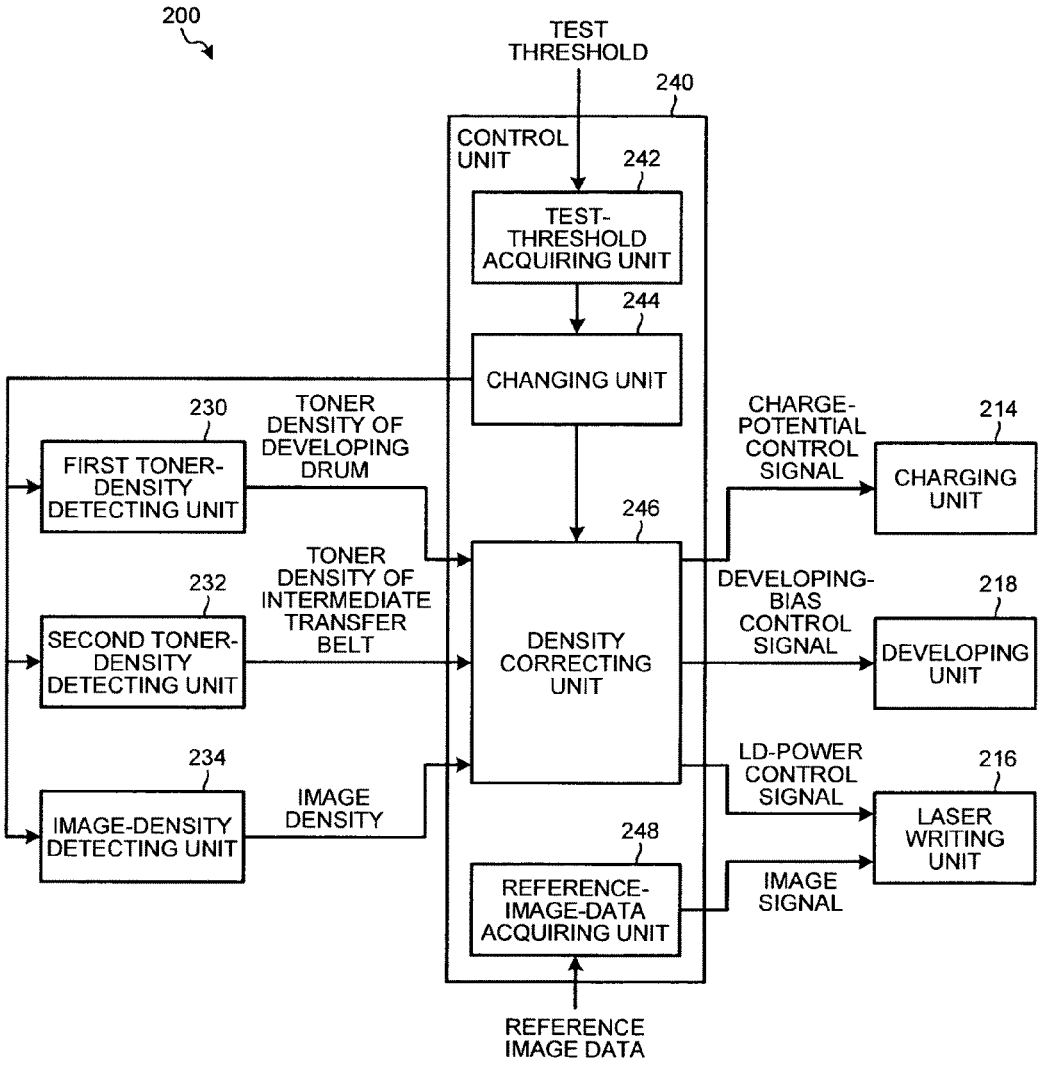
FIG. 4 is a block diagram of a configuration example of a control unit of an image output apparatus according to the present embodiment.

The control unit 240 controls each unit of the image output apparatus 200, and is realized by a known control device, such as a CPU (Central Processing Unit). FIG. 4 is a block diagram of a configuration example of the control unit 240 of the image output apparatus 200 according to the present embodiment. As illustrated in FIG. 4, the control unit 240 includes a test-threshold acquiring unit 242, a changing unit 244, a density correcting unit 246, and a reference-image-data acquiring unit 248.

The test-threshold acquiring unit 242 acquires a test threshold. In the present embodiment, an example is explained in which the test-threshold acquiring unit 242 acquires the test threshold from the image test apparatus 400. However, the test threshold may be directly acquired from the control PC 30.

The changing unit 244 changes a density detection mode of the image forming unit 210 depending on the test threshold acquired by the test-threshold acquiring unit 242. In the present embodiment, as the density detection mode of the image forming unit 210, there is a mode in which both of the first toner-density detecting unit 230 and the second toner-density detecting unit 232 detect the toner density, and there is another mode in which the image-density detecting unit 234 detects the image density.

In the present embodiment, the changing unit 244 changes a density detecting unit used for the density detection to the image-density detecting unit 234 alone or to both of the first toner-density detecting unit 230 and the second toner-density detecting unit 232 in accordance with the test threshold acquired by the test-threshold acquiring unit 242. More specifically, the changing unit 244 changes the density detecting unit to the image-density detecting unit 234 alone when the test accuracy indicated by the test threshold is higher than a reference value, and changes the density detecting unit to both of the first toner-density detecting unit 230 and the second toner-density detecting unit 232 when the test accuracy indicated by the test threshold is lower than the reference value.

However, the way to change the density detection mode of the image forming unit 210 is not limited to the above example. It is possible to change the density detesting unit used for the density detection to at least one of the first toner-density detecting unit 230, the second toner-density detecting unit 232, and the image-density detecting unit 234, in accordance with the test threshold. For example, it may be possible to change the density detecting unit used for the density detection in the following order: first, to both of the first toner-density detecting unit 230 and the second toner-density detecting unit 232; second, to only the image-density detecting unit 234; and third, to all of the first toner-density detecting unit 230, the second toner-density detecting unit 232, and the image-density detecting unit 234, along with an increase in the test accuracy indicated by the test threshold.

The density correcting unit 246 corrects density during an image forming process performed by the image forming unit 210, on the basis of a result of the density detection performed after the changing unit 244 has changed the density detection mode. Consequently, the image forming unit 210 forms an image (a user image) based on the CMYK image data at the corrected density.

Figure 5:
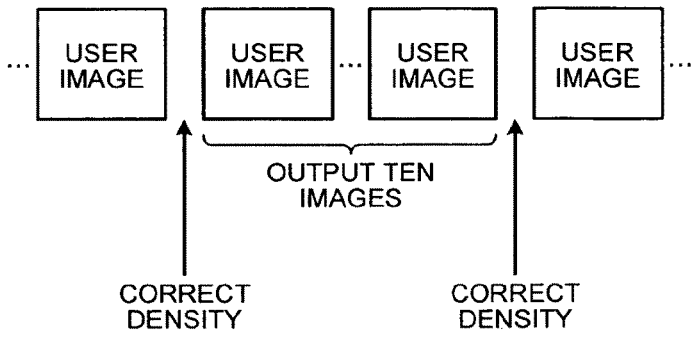
FIG. 5 is a diagram explaining an example of density correction based on a toner-density detection result.

For example, suppose that the changing unit 244 has changed the density detecting unit used for the density detection to both of the first toner-density detecting unit 230 and the second toner-density detecting unit 232. In this case, the density correcting unit 246 corrects outputs of the charge-potential control signal, the LD-power control signal, and the developing-bias control signal so that the image density becomes constant, in accordance with the results of the toner density detection performed by the first toner-density detecting unit 230 and the second toner-density detecting unit 232. In the present embodiment, as described above, the first toner-density detecting unit 230 and the second toner-density detecting unit 232 detect the toner density every ten recording sheets with formed user images are output. Therefore, as illustrated in FIG. 5, the density correcting unit 246 corrects the density as explained above (corrects outputs of the control signals) every ten recording sheets with formed user images are output.

Figure 6:
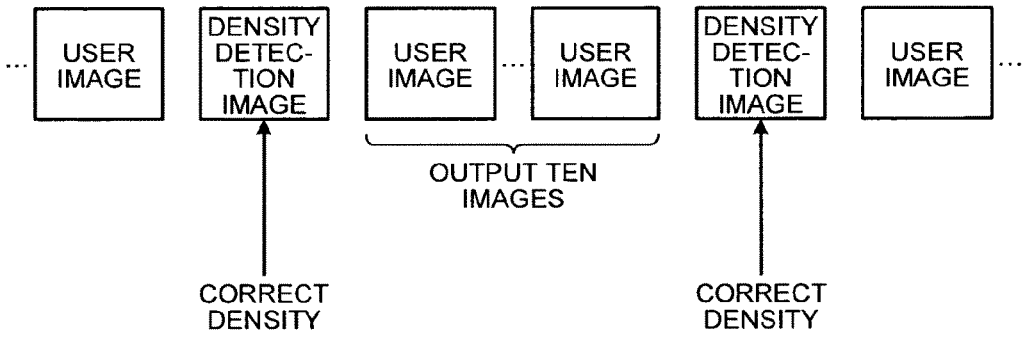
FIG. 6 is a diagram explaining an example of density correction based on an image-density detection result.

For example, suppose that the changing unit 244 has changed the density detecting unit to the image-density detecting unit 234. In this case, the density correcting unit 246 corrects outputs of the charge-potential control signal, the LD-power control signal, and the developing-bias control signal so that the image density becomes constant, in accordance with the result of the image density detection performed by the image-density detecting unit 234. In the present embodiment, as described above, a recording sheet on which the density detection image is formed is output every ten recording sheets with formed user images are output, and the image-density detecting unit 234 detects the density of this image. Therefore, as illustrated in FIG. 6, the density correcting unit 246 corrects the density as explained above (corrects outputs of the control signals) every ten recording sheets with formed user images are output.

As the concrete way to correct outputs of the control signals, any known techniques can be used.

The reference-image-data acquiring unit 248 acquires the 8-bit-based CMYK image data that has been transmitted from the DFE 20. The reference-image-data acquiring unit 248 outputs the acquired CMYK image data, as an image signal of the CMYK image data, to the laser writing unit 216.

Operations of the image test system according to the present embodiment will be explained below.

Figure 7:
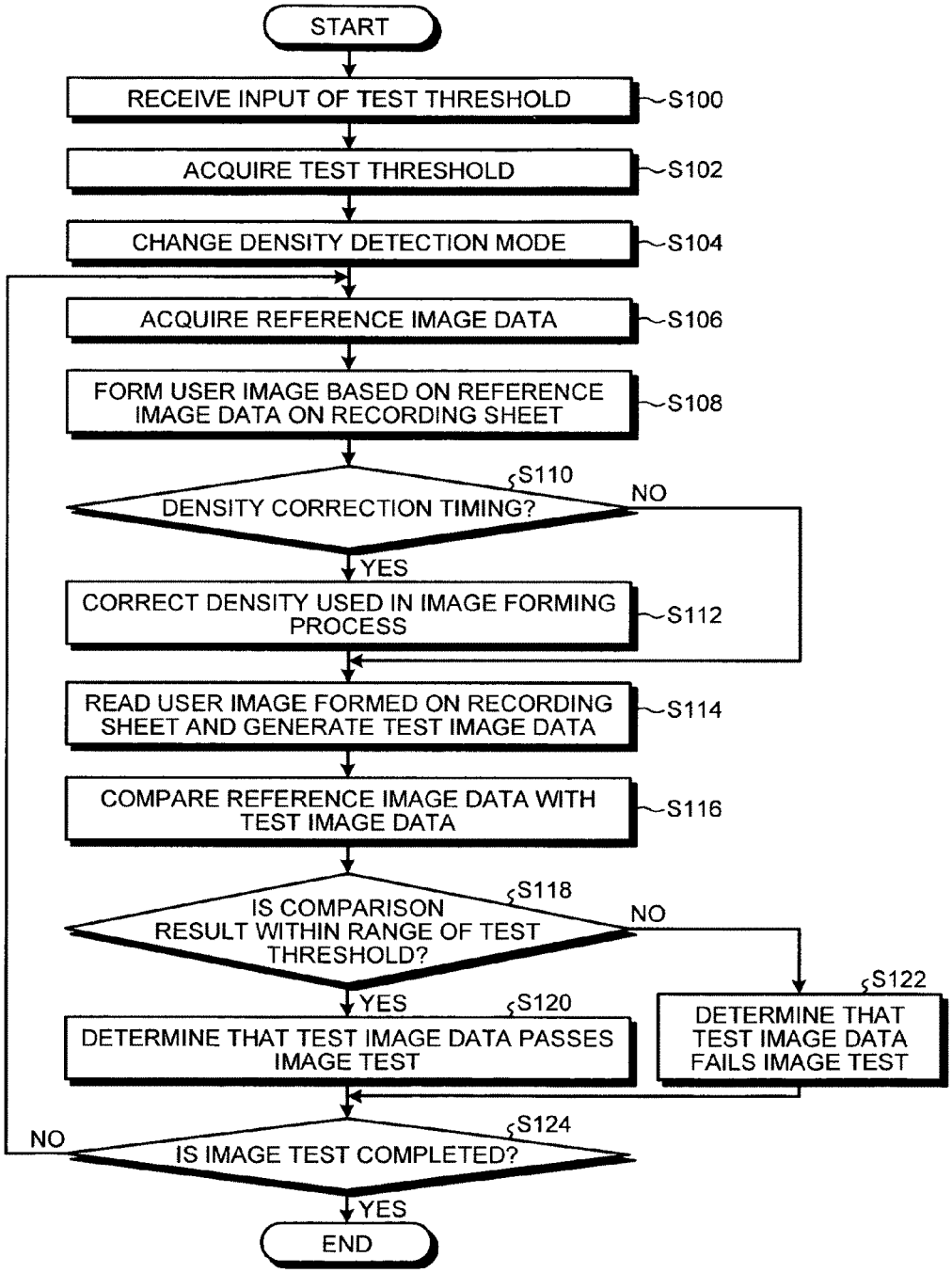
FIG. 7 is a flowchart of an example of density correction processing performed by the image test system according to the present embodiment.

FIG. 7 is a flowchart of an example of density correction processing performed by the image test system 100 according to the present embodiment.

The test-threshold receiving unit 410 of the image test apparatus 400 receives input of a test threshold to be used as a pass-fail criterion for the image test (Step S100).

The test-threshold acquiring unit 242 of the image output apparatus 200 acquires, from the image test apparatus 400, the test threshold input to the image test apparatus 400 (Step S102).

The changing unit 244 of the image output apparatus 200 changes the density detection mode of the image forming unit 210 in accordance with the test threshold acquired by the test-threshold acquiring unit 242 (Step S104). In the present embodiment, the changing unit 244 changes the density detecting unit used for the density detection to the image-density detecting unit 234 when the test accuracy indicated by the test threshold is higher than the reference value, and changes the density detecting unit used for the density detection to both of the first toner-density detecting unit 230 and the second toner-density detecting unit 232 when the test accuracy indicated by the test threshold is lower than the reference value.

The reference-image-data acquiring unit 248 of the image output apparatus 200 acquires reference image data transmitted from the DFE 20 (Step S106).

The image forming unit 210 of the image output apparatus 200 forms a user image based on the reference image data acquired by the reference-image-data acquiring unit 248 on a recording sheet and outputs the recording sheet (Step S108).

When it is the density correction timing (YES at Step S110), the density correcting unit 246 of the image output apparatus 200 corrects the density used in the image forming process performed by the image forming unit 210, on the basis of the result of the density detection performed after the changing unit 244 has changed the density detection mode (Step S112).

For example, at Step S104, suppose that the density detecting unit used for the density detection is changed to the image-density detecting unit 234. In this case, the image forming unit 210 forms a toner image used for the density detection every ten recording sheets with formed user images are output, and the first toner-density detecting unit 230 and the second toner-density detecting unit 232 detect the density. Therefore, every ten recording sheets with formed user images are output, the density correcting unit 246 corrects outputs of the charge-potential control signal, the LD-power control signal, and the developing-bias control signal so that the image density becomes constant, in accordance with the results of the toner density detection performed by the first toner-density detecting unit 230 and the second toner-density detecting unit 232.

For another example, at Step S104, suppose that the density detecting unit used for the density detection is changed to the image-density detecting unit 234. In this case, the image forming unit 210 outputs a recording sheet on which the density detection image is formed, every ten recording sheets with formed user images are output, and then the image-density detecting unit 234 detects the image density. Therefore, every time the recording sheet with the formed density detection image is output, i.e., every ten recording sheets with formed user images are output, the density correcting unit 246 corrects outputs of the charge-potential control signal, the LD-power control signal, and the developing-bias control signal so that the image density becomes constant, in accordance with the result of the image density detection performed by the image-density detecting unit 234.

When it is not the density correction timing (NO at Step S111), the density correction at Step S112 is not performed.

The image reading apparatus 300 reads the user image that has been formed on the recording sheet by the image output apparatus 200, and generates test image data (Step S114).

The image testing unit 440 of the image test apparatus 400 acquires the reference image data that has been transmitted from the DFE 20 and converted by the first color converting unit 420; acquires the test image data that has been generated by the image reading apparatus 300 and converted by the second color converting unit 430; and compares the acquired test image data and the acquired reference image data with each other (Step S116).

When the comparison result is within the range of the test threshold received by the test-threshold receiving unit 410 (YES at Step S118), the image testing unit 440 determines that the test image data passes the image test (Step S120). On the other hand, when the comparison result is not within the range of the test threshold received by the test-threshold receiving unit 410 (NO at Step S118), the image testing unit 440 determines that the test image data does not pass (fails) the image test (Step S122).

When the test on all pieces of the image data is completed, the density correction processing ends (YES at Step S124). When the test on all pieces of the image data is not completed, the processing returns to Step S106 (NO at Step S124), where the image test is continued.

As described above, according to the present embodiment, the density detection mode of the image forming unit 210 is changed in accordance with the test threshold that is the pass-fail criterion for the image test, and the density used in the image forming process performed by the image forming unit 210 is corrected on the basis of the result of the density detection performed after the density detection mode has been changed.

Therefore, according to the present embodiment, the density correction accuracy is automatically changed to the accuracy appropriate for the pass-fail criterion for the image test, in conjunction with the pass-fail criterion. Consequently, it is possible to provide printed matters of the quality required by a user in the minimum processing time, so that the productivity of the printed matters can be increased. Therefore, it is possible to prevent a situation in which a large amount of defective printed matters are generated due to low density correction accuracy with respect to the pass-fail criterion for the image test, or a situation in which processing time for the density correction increases due to high density correction accuracy with respect to the pass-fail criterion for the image test. Consequently, it is possible to prevent decrease in the productivity of printed matters. Furthermore, according to the present embodiment, because it is possible to prevent generation of a large number of defective printed matters, it is possible to reduce costs and contribute to environmental protection.

For example, according to the present embodiment, the density detecting unit used for the density detection is changed to the image-density detecting unit 234 when the test accuracy indicated by the test threshold is high. This is because the accuracy of the density detection performed by the image-density detecting unit 234 is higher than the accuracy of the toner-image density detection performed by the first toner-density detecting unit 230 and the second toner-density detecting unit 232 because the image-density detecting unit 234 directly measures the density of an image formed on a recording sheet. Therefore, it is possible to prevent generation of a large number of defective printed matters due to the low density correction accuracy with respect to the pass-fail criterion for the image test, and it is possible to provide printed matters of the quality required by a user in the minimum processing time. As a result, the productivity of the printed matters can be increased.

Furthermore, according to the present embodiment, the density detecting unit used for the density detection is changed to both of the first toner-density detecting unit 230 and the second toner-density detecting unit 232 when the test accuracy indicated by the test threshold is low. This is because, in the density detection performed by the first toner-density detecting unit 230 and the second toner-density detecting unit 232, it is not necessary to actually form an image on a recording sheet because the first toner-density detecting unit 230 and the second toner-density detecting unit 232 only measures the density of a toner image, and it, is therefore possible to reduce the processing time for the density correction compared with the density detection performed by the image-density detecting unit 234. Consequently, it is possible to prevent an increase in the processing time for the density correction due to the high density correction accuracy with respect to the pass-fail criterion for the image test, and it is possible to provide printed matters of the quality required by the user in the minimum processing time. As a result, the productivity of the printed matters can be increased.

Modifications

The present invention is not limited to the above embodiment, and may be modified in various forms.

First Modification

In the above embodiment, the example has been explained in which the density detecting unit used for the density detection is changed exclusively to the image-density detecting unit 234 or both of the first toner-density detecting unit 230 and the second toner-density detecting unit 232, in accordance with the test threshold. However, the way to change the density detection mode of the image forming unit 210 on the basis of the test threshold is not limited to this example. It is possible to cause all of the first toner-density detecting unit 230, the second toner-density detecting unit 232, and the image-density detecting unit 234 to perform the density detection, and change the frequency of the density detection of any of the density detection units in accordance with the test threshold.

For example, the first toner-density detecting unit 230 and the second toner-density detecting unit 232 detect the toner density every ten recording sheets with formed user images are output. If the test accuracy indicated by the test threshold is the lowest, the image-density detecting unit 234 detects the image density every 200 recording sheets are output, and the frequency of the image density detection performed by the image-density detecting unit 234 may be increased as the test accuracy indicated by the test threshold increases. Accordingly, the density correction accuracy increases along with an increase in the frequency of the image density detection performed by the image-density detecting unit 234. Furthermore, the processing time needed for the density correction decreases along with a decrease in the frequency of the image density detection performed by the image-density detecting unit 234. Therefore, it is possible to achieve the same advantages as those of the above described present embodiment.

In the first modification, the example has been explained in which the image output apparatus 200 includes the first toner-density detecting unit 230, the second toner-density detecting unit 232, and the image-density detecting unit 234. However, the first modification may be applied to an apparatus that includes only the image-density detecting unit 234.

It is also possible to change, for example, the frequency of the toner density detection performed by both of the first toner-density detecting unit 230 and the second toner-density detecting unit 232 in the above manner, in addition to change in the frequency of the image density detection performed by the image-density detecting unit 234. Even in this case, it is possible to achieve the same advantages as those obtained when the frequency of the image density detection performed by the image-density detecting unit 234 is changed. Besides, it is possible to minimize the toner consumption. Incidentally, because high-end image output apparatuses are generally operated in the environment with the constant temperature and humidity, it is advantageous to make the configuration so that the interval between the correction operations can be changed when the apparatuses are stably operating.

Second Modification

In the above described present embodiment, the example has been explained in which the image-density detecting unit 234 is provided in the image output apparatus 200. However, the present invention is not limited to this example. It is possible to simultaneously detect the image density of an image when the image reading apparatus 300 (line sensor) reads the image that has been formed on a recording sheet by the image output apparatus 200.

With this configuration, because the image reading apparatus 300 plays the role of the image-density detecting unit 234, it is not necessary to arrange the image-density detecting unit 234 in the image output apparatus 200; therefore, costs can be reduced. Besides, because the same device (the image reading apparatus 300) reads an image and detects the density of the same image, it is possible to reduce errors. Therefore, it is possible to increase the entire processing accuracy of the image test system 100.

Third Modification

In the above described present embodiment, the example has been explained in which the density correcting unit 246 corrects the density on the assumption that the density of an image formed on a recording sheet is constant at any portions of the recording sheet. However, in some cases, it may be possible that the density of an image varies depending on positions in the same recording sheet due to eccentricity of the developing drum 212 or variation of the sensitivity cycle of the developing drum 212. However, the degree of such density variation is generally specific to a model, so that it is possible to estimate the degree of the density variation at the time of designing.

Figure 8:
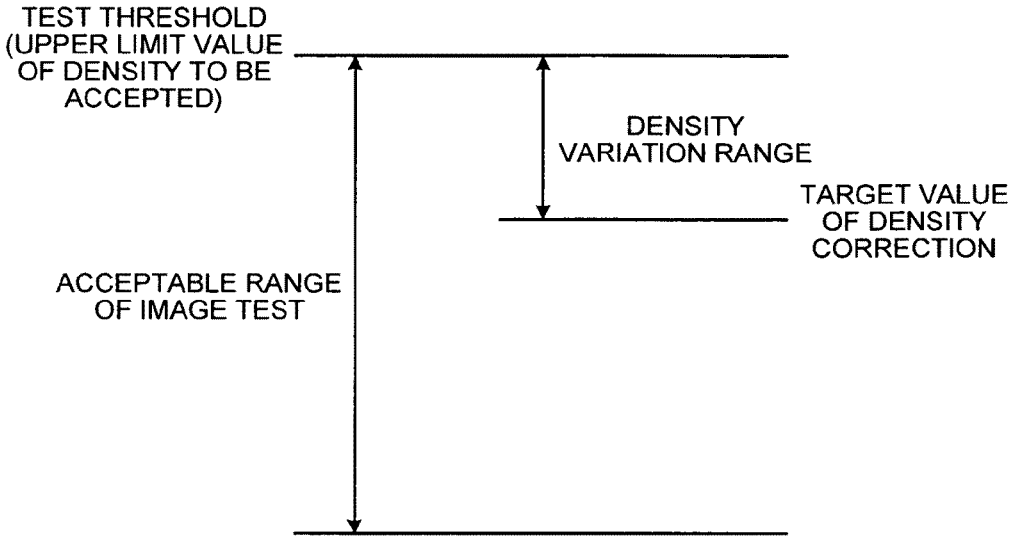
FIG. 8 is a diagram explaining how to determine a target value of the density to be corrected.

Therefore, the density correcting unit 246 may perform the density correction by taking the density variation into consideration. More specifically, as illustrated in FIG. 8, the density correcting unit 246 may correct the density on the basis of a target value that is obtained by subtracting a value, which corresponds to the range of the density variation caused by in-plane variation, from the upper limit of the image density with which the image data passes the image test based on the test threshold. With this configuration, it is possible to perform the density correction by taking the density variation caused by in-plane variation into consideration.

However, when image data has passed the image test at the upper limit (the same value as the test threshold) of the image density with which the image data passes the image test, it may be a harbinger of failure or malfunction that may occur inside the image output apparatus 200. Furthermore, it may be possible that the image data has passed the image test only because the amount of the in-plane density variation is decreased by coincidence. Therefore, it is possible for the control PC 30 to notify a user of the detection result by using a display (not illustrated) when the image test result sent by the image test apparatus 400 indicates that the image data has passed the image test at the upper limit of the image density with which the image data passes the image test.

Fourth Modification

The present embodiment and the modifications described above may be combined appropriately.

Hardware Configuration

Figure 9:
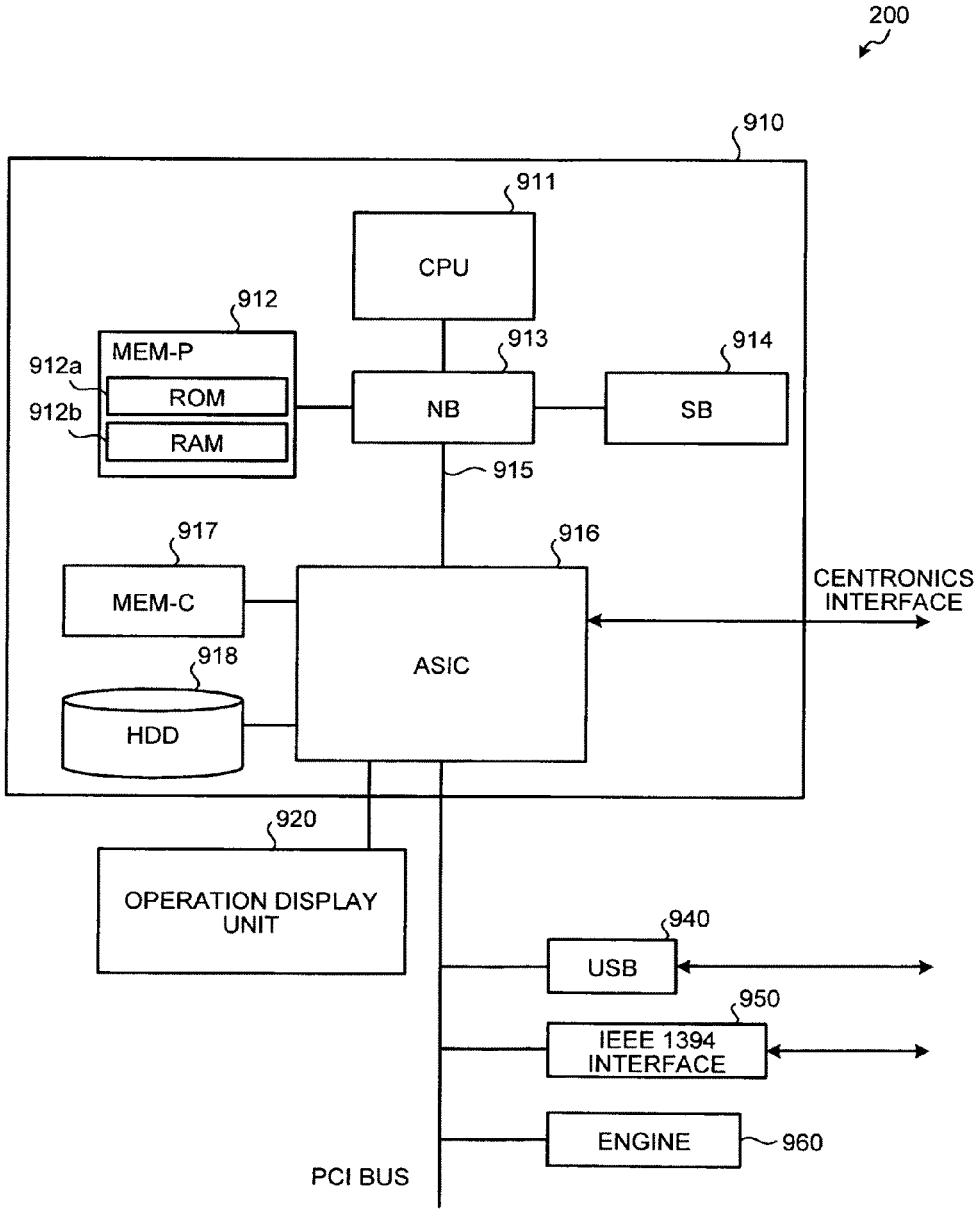
FIG. 9 is a block diagram of a hardware configuration example of the image output apparatus according to the present embodiment and modifications.

FIG. 9 is an exemplary block diagram of a hardware configuration of the image output apparatus 200 according to the above described present embodiment and the modifications.

As illustrated in FIG. 9, the image output apparatus 200 includes a controller 910 and an engine unit (Engine) 960 that are connected to each other with a PCI (Peripheral Component Interconnect) bus. The controller 910 is a controller that controls the entire image output apparatus 200, picture processing, communications, and inputs that are inputted from an operation display unit 920. The engine unit 960 is an engine or the like that is connectable to the PCI bus. Examples of the engine unit 960 include a printer engine used for a monochrome plotter, a one-drum color plotter, a four-drum color plotter or the like. The engine unit 960 includes an image processing section for performing error diffusion, gamma correction, or the like, in addition to the engine section.

The controller 910 includes a CPU 911, a north bridge (NB) 913, a system memory (MEM-P) 912, a south bridge (SB) 914, a local memory (MEM-C) 917, an ASIC (Application Specific Integrated Circuit) 916, and a hard disk drive (HDD) 918. The north bridge (NB) 913 and the ASIC 916 are connected to an AGP (Accelerated Graphics Port) bus 915. The MEM-P 912 includes a ROM 912*a* and a RAM 912*b*.

The CPU 911 controls the entire image output apparatus 200, and includes a chip set formed of the NB 913, the MEM-P 912, and the SB 914. The CPU 911 is connected to other apparatuses via the chip set.

The NB 913 is a bridge for connecting the CPU 911, the MEM-P 912, the SB 914, and the AGP bus 915 to one another. The NB 913 includes a memory controller for controlling read and write with respect to the MEM-P 912, and also includes a PCI master and an AGP target.

The MEM-P 912 is a system memory used as a memory for storing computer programs and data, a memory for loading computer programs and data, and a memory for use in picture drawing performed by a printer. The MEM-P 912 includes the ROM 912*a* and the RAM 912*b*. The ROM 912*a* is a read-only memory used for storing computer programs and data. The RAM 912*b* is a writable and readable memory used for loading computer programs and data or used for picture processing performed by a printer.

The SB 914 is a bridge for connecting the NB 913, PCI devices, and peripheral devices to one another. The SB 914 is connected to the NB 913 via the PCI bus. A network interface (I/F) or the like is also connected to the PCI bus.

The ASIC 916 is an IC (Integrated Circuit) used for image processing that includes a hardware element for image processing, and has a function as a bridge to connect the AGP bus 915, the PCI bus, the HDD 918, and the MEM-C 917 to one another. The ASIC 916 includes: a PCI target and an AGP master; an arbiter (ARB) that is the central core of the ASIC 916; a memory controller that controls the MEM-C 917; a plurality of DMACs (Direct Memory Access Controllers) that performs the rotation of image data, or the like, by using hardware logic; and a PCI unit that performs data transfer with the engine unit 960 via the PCI bus. A USB (Universal Serial Bus) 940, an IEEE 1394 (Institute of Electrical and Electronics Engineers 1394) interface 950 are connected to the ASIC 916 via the PCI bus. The operation display unit 920 is directly connected to the ASIC 916.

The MEM-C 917 is a local memory for use as a copy image buffer and a code buffer. The HDD 918 is a storage device for storing image data, computer programs, font data, and forms.

The AGP bus 915 is a bus interface for a graphics accelerator card introduced to speed up graphics operations and allows direct access to the MEM-P 912 with a high throughput, thereby speeding up operations related to the graphic accelerator card.

Density correction computer programs to be executed by the image output apparatus 200 can be provided as being preinstalled in a ROM or the like.

The density correction computer programs to be executed by the image output apparatus 200 can be configured so as to be provided as being recorded in a computer-readable recording medium, such as a (CD-ROM), a flexible disk (FD), a CD-R, or a digital versatile disk (DVD), in an installable or executable format.

The density correction computer programs to be executed by the image output apparatus 200 can be configured so as to be stored in a computer connected to a network such as the Internet so that the computer programs are provided by downloading via the network. The information registration computer programs to be executed by the image output apparatus 200 can be configured so as to be provided or distributed via a network, such as the Internet.

The density correction computer programs to be executed by the image output apparatus 200 have a module structure made of the above-mentioned units. As actual hardware, the CPU reads the information registration computer programs from the ROM and executes them to load the units on the main memory, thereby generating the above units on the main memory.

According to one aspect of the present invention, it is possible to increase the productivity of printed matters.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image output apparatus comprising:

an image forming unit that forms an image on a recording medium;

a test-threshold acquiring unit that acquires a test threshold that is a pass-fail criterion for an image test and compares test image data, the test image data being generated by an image reading apparatus by using the image formed on the recording medium and being used as a test object for the image test, with reference image data, the reference image data being used as a test reference for the image test, to determine whether the test image data passes or fails the image test based on the acquired test threshold;

a changing unit that changes a density detection mode of at least one of the image forming unit and the image reading apparatus on the basis of the test threshold;

a density correcting unit that corrects density used in an image forming process performed by the image forming unit, on the basis of a result of density detection performed after the density detection mode is changed; and a reference-image-data acquiring unit that acquires the reference image data, wherein the image forming unit forms an image of the reference image data on a recording medium at the corrected density.

2. The image output apparatus according to claim 1, wherein the image forming unit includes a toner-density detecting unit that detects density of toner; and an image-density detecting unit that detects density of a density-measurement image that is formed on a recording medium, wherein the changing unit changes a density detecting unit used for density detection to at least one of the toner-density detecting unit and the image-density detecting unit on the basis of the test threshold.

3. The image output apparatus according to claim 1, wherein the image forming unit includes an image-density detecting unit that detects density of a density-measurement image that is formed on a recording medium, wherein the changing unit changes frequency of density detection performed by the image-density detecting unit on the basis of the test threshold.

4. The image output apparatus according to claim 3, wherein the image forming unit further includes a toner-density detecting unit that detects density of toner, wherein the changing unit changes frequency of density detection performed by the toner-density detecting unit on the basis of the test threshold.

5. The image output apparatus according to claim 1, wherein the density correcting unit corrects density on the basis of a target value that is obtained by subtracting a value corresponding to density variation caused by in-plane variation from an upper limit of image density with which the image data passes the image test based on the test threshold.

6. The image output apparatus according to claim 1, wherein the reference image data is raster image data.

7. An image test system comprising:

an image reading apparatus that reads an image formed on a recording medium and generates test image data that is used as a test object for an image test;

an image test apparatus that includes a test-threshold receiving unit that receives input of a test threshold that is a pass-fail criterion for the image test; and an image testing unit that acquires reference image data that is used as a test reference for the image test, acquires the test image data, compares the test image data with the reference image data, and determines whether a comparison result is in the range of the test threshold to thereby determine whether the test image data passes the image test; and an image output apparatus that includes an image forming unit that forms an image;

a test-threshold acquiring unit that acquires the test threshold;

a changing unit that changes a density detection mode of at least one of the image forming unit and the image reading apparatus in accordance with the test threshold;

a density correcting unit that corrects density used in an image forming process performed by the image forming unit, on the basis of a result of density detection performed after the density detection mode has been changed; and a reference-image-data acquiring unit that acquires the reference image data, wherein the image forming unit forms an image on a recording medium on the basis of the reference image data and at the corrected density.

8. The image test system according to claim 7, wherein the image forming unit includes a toner-density detecting unit that detects density of toner; and an image-density detecting unit that detects density of a density-measurement image that is formed on a recording medium, wherein the changing unit changes a density detecting unit used for density detection to at least one of the toner-density detecting unit and the image-density detecting unit on the basis of the test threshold.

9. The image test system according to claim 7, wherein the image forming unit includes an image-density detecting unit that detects density of a density-measurement image that is formed on a recording medium, wherein the changing unit changes frequency of density detection performed by the image-density detecting unit on the basis of the test threshold.

10. The image test system according to claim 9, wherein the image forming unit further includes a toner-density detecting unit that detects density of toner, wherein the changing unit changes frequency of density detection performed by the toner-density detecting unit on the basis of the test threshold.

11. The image test system according to claim 7, wherein the image reading apparatus detects density of a density-measurement image formed on a recording medium, the image forming unit includes a toner-density detecting unit that detects density of toner, and the changing unit changes a density detection mode of at least one of the toner-density detecting unit and the image reading apparatus in accordance with the test threshold.

12. The image test system according to claim 7, wherein the density correcting unit corrects density on the basis of a target value that is obtained by subtracting a value corresponding to density variation caused by in-plane variation from an upper limit of image density with which the image data passes the image test based on the test threshold.

13. The image test system according to claim 12, wherein when the comparison result is the same as the test threshold, the image testing unit issues a notice indicating that the test image data has passed the image test at the test threshold.

14. A density correction method to be performed by an image output apparatus that includes an image forming unit that forms an image on a recording medium, the density correction method comprising:

comparing, by a test-threshold acquiring unit, test image data, the test image data being generated by an image reading apparatus by using the image formed on the recording medium and being used as a test object for an image test, with reference image data, the reference image data being used as a test reference for the image test;

acquiring, by the test-threshold acquiring unit, a test threshold that is a pass-fail criterion for the image test for determining whether the test image data passes or fails the image test, on the basis of a result obtained at the comparing;

changing, by a changing unit, a density detection mode of at least one of the image forming unit and the image reading apparatus on the basis of the test threshold;

correcting, by a density correcting unit, density used in an image forming process performed by the image forming unit, on the basis of a result of density detection performed after the density detection mode is changed;

acquiring, by a reference-image-data acquiring unit, the reference image data; and forming, by the image forming unit, an image of the reference image data on a recording medium at the corrected density.

* * * * *